US012674281B2

(12) United States Patent
Niederhuber et al.

(10) Patent No.: US 12,674,281 B2
(45) Date of Patent: Jul. 7, 2026

(54) COMPOSTABLE PACKAGING MATERIAL

(71) Applicant: Neenah Gessner GmbH, Bruckmühl (DE)

(72) Inventors: Armin Niederhuber, Bruckmühl (DE); Sabrina Ruber, Bruckmühl (DE)

(73) Assignee: Neenah Gessner GmbH (DE)

( * ) Notice: Subject to any disclaimer, the term of this patent is extended or adjusted under 35 U.S.C. 154(b) by 99 days.

(21) Appl. No.: 18/401,909

(22) Filed: Jan. 2, 2024

(65) Prior Publication Data

US 2024/0218601 A1 Jul. 4, 2024

(51) Int. Cl.

| | |
|---|---|
| ***D21H 19/82*** | (2006.01) |
| ***D21H 19/18*** | (2006.01) |
| ***D21H 19/24*** | (2006.01) |
| ***D21H 27/10*** | (2006.01) |

(52) U.S. Cl.
CPC ..... *D21H 19/824* (2013.01); *D21H 19/18* (2013.01); *D21H 19/24* (2013.01); *D21H 27/10* (2013.01)

(58) Field of Classification Search
None
See application file for complete search history.

(56) References Cited

U.S. PATENT DOCUMENTS

| | | | | |
|---|---|---|---|---|
| 5,837,383 | A * | 11/1998 | Wenzel | D21H 19/40 428/903.3 |
| 2004/0099390 | A1* | 5/2004 | Trochlil | D21H 19/36 162/158 |
| 2005/0112387 | A1 | 5/2005 | Druckrey et al. | |
| 2022/0259805 | A1 | 8/2022 | Dag | |

FOREIGN PATENT DOCUMENTS

| | | | | |
|---|---|---|---|---|
| DE | 102017202887 | A1 | 8/2018 | |
| WO | WO-2022243445 | A1 * | 11/2022 | D21H 19/28 |

OTHER PUBLICATIONS

Khwaldia K., "Water Vapor Barrier and Mechanical Properties of Paper-Sodium Caseinate and Paper-Sodium Caseinate-Paraffin Wax Films : Paper-Sodium Caseinate-Paraffin Wax Films", Journal of Food Biochemistry., vol. 0 34, No. 0 5, May 20, 2010 (May 20, 2010), p. 998-1013, XP093146963.

Despond, S. et al, "Barrier properties of paper-chitosan and paper-chitosan-carnauba wax films", Journal of Applied Polymer Science,vol. 0 98, No. 0 2, Jan. 1, 2005 (Jan. 1, 2005), p. 704-710, XP055068110.

Nassar Mona A et al, "Formulation and Application of Whey-Protein Based Coatings for Improved Paperboard Properties", Egypt. J. Chem.,vol. 0 56, No. 0 3, Dec. 31, 2013 (Dec. 31, 2013), p. 213-224, XP093146976 abstract.

* cited by examiner

*Primary Examiner* — Chinessa T. Golden
(74) *Attorney, Agent, or Firm* — Farber LLC

(57) ABSTRACT

The present disclosure is directed to a coated paper. The coated paper includes a cellulose layer and at least two coatings on one side of the paper. The first coating applied to the paper is a barrier coating that can be made from a plant or animal derived component, which is preferably water-soluble or water-dispersible, and more preferably water-soluble. The second coating, on the other hand, can be a heat-sealable coating. The coated paper is particularly well suited to constructing packages.

20 Claims, 2 Drawing Sheets

COMPOSTABLE PACKAGING MATERIAL

RELATED APPLICATIONS

The present application is based upon and claims priority to U.S. Provisional Patent Application Ser. No. 63/436,196, having a filing date of Dec. 30, 2022 and DE Application No. 10 2022 214 453.8, having a filing date of Dec. 30, 2022, both of which are incorporated herein by reference.

BACKGROUND

The majority of flexible packaging materials on the market for producing non-rigid packages are made from fossil-based polymers. These materials include, for instance, multi-layer films containing polyethylene terephthalate polymers and/or polyethylene polymers. Although these films can provide excellent barrier properties and are heat-sealable, the films are not sustainable and are not environmentally friendly. These films and the packaging made from the films comprise single-use plastics that are only used once and then disposed. Although some single-use plastics can end up in the recycling stream, much of these materials end up in landfills at very slow degradation rates.

In view of the above, those skilled in the art have attempted to replace fossil-based plastic films with paper materials. Paper products, for instance, are formed from sustainable resources, are biodegradable, and are compostable. Paper, however, has various disadvantages and drawbacks when used as a packaging material. For instance, paper can easily tear, is not water-resistant, and does not have heat seal properties.

WO 2022/243445 entitled "Coated Paper For Use as Packaging Material," which is incorporated herein by reference, discloses a heat-sealable, coated paper comprising a cellulose layer and a coating on at least one side of the cellulose layer. The coating comprises a wax and a polymer selected from a polyester, a polysaccharide, a polysaccharide ester, a polysaccharide ether, or a polysaccharide ether ester. Although WO '445 has provided great advances in the art, further improvements are still needed. In particular, a need exists for a heat-sealable coated paper that has enhanced barrier properties. For instance, a need exists for a coated paper that has relatively low moisture vapor and oxygen transmission rates.

SUMMARY

It is an object of the present invention to provide a coated paper well suited for use as a packaging material that not only has excellent barrier properties, such as low moisture vapor and oxygen transmission rates, but has also excellent heat-sealable properties. In one aspect, the coated paper can be made to be completely biodegradable and/or compostable, preferably home-compostable. For instance, the coated paper can be formulated in order to pass compostable test EN 13432:2001. In addition to being sustainable and environmentally friendly, the coated paper of the present disclosure also has excellent mechanical properties, is easy to process, and can have excellent barrier properties.

In one aspect, the coated paper includes a cellulose layer having a first side and a second and opposite side. A barrier coating is applied to the first side of the cellulose layer. The barrier coating comprises a plant or animal derived component, which is preferably water-soluble or water-dispersible, and more preferably water-soluble. A heat-sealable coating is applied over the barrier coating. The heat-sealable coating comprises a wax.

The barrier coating in combination with the heat-sealable coating provides the coated paper not only with heat-sealable properties but also with excellent barrier properties. For instance, the coated paper can display a moisture vapor transmission rate (MVTR) of less than about 10 $g/m^2/24$ hours, preferably less than about 9 $g/m^2/24$ hours, more preferably less than about 8 $g/m^2/24$ hours, even more preferably less than about 7 $g/m^2/24$ hours, even further more preferably less than about 6 $g/m^2/24$ hours, even further more preferably less than about 5 $g/m^2/24$ hours, even further more preferably less than about 4 $g/m^2/24$ hours, even further more preferably less than about 3 $g/m^2/24$ hours, even further more preferably less than about 2 $g/m^2/24$ hours, most preferably less than about 1 $g/m^2/24$ hours. The coated paper 10 can also display excellent oxygen barrier properties. For instance, the coated paper can display an oxygen transmission rate (OTR) of less than about 2 $cm^3/m^2/24$ hours, preferably less than about 1.75 $cm^3/m^2/24$ hours, more preferably less than about 1.5 $cm^3/m^2/24$ hours, even more preferably less than about 1.25 $cm^3/m^2/24$ hours, even further more preferably less than about 1 $cm^3/m^2/24$ hours, even further more preferably less than about 0.75 $cm^3/m^2/24$ hours, even further more preferably less than about 0.5 $cm^3/m^2/24$ hours, most preferably less than about 0.25 $cm^3/m^2/24$ hours.

The barrier coating applied to the cellulose layer of the present disclosure significantly improves the barrier properties, and specifically provides low oxygen transmission rates, while the heat-sealable coating not only provides heat-sealable properties but also protects the barrier coating from degradation. As described above, the barrier coating comprises a plant or animal derived component, which is optionally water-soluble or water-dispersible and can also be amorphous. In one aspect, the plant or animal derived component can be a milk protein.

The barrier coating can be applied to the cellulose layer so as to have a basis weight of at least about 2 $g/m^2$, such as at least about 4 $g/m^2$, such as at least about 6 $g/m^2$, such as at least about 8 $g/m^2$, such as at least about 10 $g/m^2$, such as at least about 12 $g/m^2$, such as at least about 14 $g/m^2$, and less than about 25 $g/m^2$, such as less than about 20 $g/m^2$, such as less than about 18 $g/m^2$. In addition to the plant or animal derived component, the barrier coating can contain various other components including polymers and/or fillers. For example, the barrier coating can also contain, in one aspect, a polyvinyl alcohol polymer. In still another embodiment, the barrier coating can contain cellulose particles, such as nanocrystalline cellulose.

The wax contained in the heat-sealable coating can be, in one aspect, a plant wax. The plant wax, for instance, can be a candelilla wax, carnauba wax, a rice bran wax, a soy wax, a sugarcane wax, a sunflower wax, pea wax, coconut wax and palm tree wax or combinations thereof, and preferably soy wax. In one aspect, the heat-sealable coating can further contain a polymer. The polymer can be a polyester, a polysaccharide, a polysaccharide ester, a polysaccharide ether, a polysaccharide ether ester, a latex polymer or combinations thereof. In one aspect, the polymer can be a thermoplastic starch. The heat-sealable coating can be applied to the cellulose layer so as to have a basis weight of equal to or greater than about 1 $g/m^2$, such as equal to or greater than about 2 $g/m^2$, such as equal to or greater than about 3 $g/m^2$, such as equal to or greater than about 4 $g/m^2$, such as equal to or greater than about 5 $g/m^2$, and generally equal to or less than about 25 g/m$^2$, such as equal to or less than about 20 g/m$^2$, such as equal to or less than about 18 g/m$^2$, such as equal to or less than about 15 g/m$^2$, such as equal to or less than about 12 g/m$^2$.

In one embodiment, the coated paper only includes two coatings, namely the barrier coating and the heat-sealable coating. Alternatively, a print receptive coating can be applied to the second side of the cellulose layer opposite the barrier coating and the heat-sealable coating. In one aspect, the coated paper is constructed such that the product does not contain a petroleum-based synthetic polymer and/or does not contain any adhesive layers in between the barrier coating and the first side of the cellulose layer or between the barrier coating and the heat-sealable coating.

The cellulose layer can be made from any suitable cellulose fibers. For instance, the cellulose layer can be made from wood pulp fibers, such as softwood fibers. The cellulose layer can also be made from bast fibers, such as bast pulp fibers. The bast fibers can be hemp fibers, flax fibers, or the like. The cellulose layer can also contain hardwood fibers. In one aspect, the cellulose layer can contain wood pulp fibers alone or in combination with bast fibers. The cellulose layer can have a basis weight of generally from about 20 g/m$^2$ to about 200 g/m$^2$, including all increments of 1 g/m$^2$ therebetween. For instance, the cellulose layer can have a basis weight of from about 20 g/m$^2$ to about 100 g/m$^2$, such as from about 30 g/m$^2$ to about 70 g/m$^2$. The coated paper product, on the other hand, can have an overall basis weight of from about 25 g/m$^2$ to about 250 g/m$^2$, including all increments of 1 g/m$^2$ therebetween. For instance, the coated paper product can have a basis weight of from about 25 g/m$^2$ to about 125 g/m$^2$, such as from about 35 g/m$^2$ to about 90 g/m$^2$, such as from about 40 g/m$^2$ to about 80 g/m$^2$.

The present disclosure is also directed to a packaging formed from the coated paper. In one embodiment, the packaging can define a hollow enclosure or interior volume that is formed between two layers of the coated paper. The coated paper can be heat-sealed together along the margins of the product.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
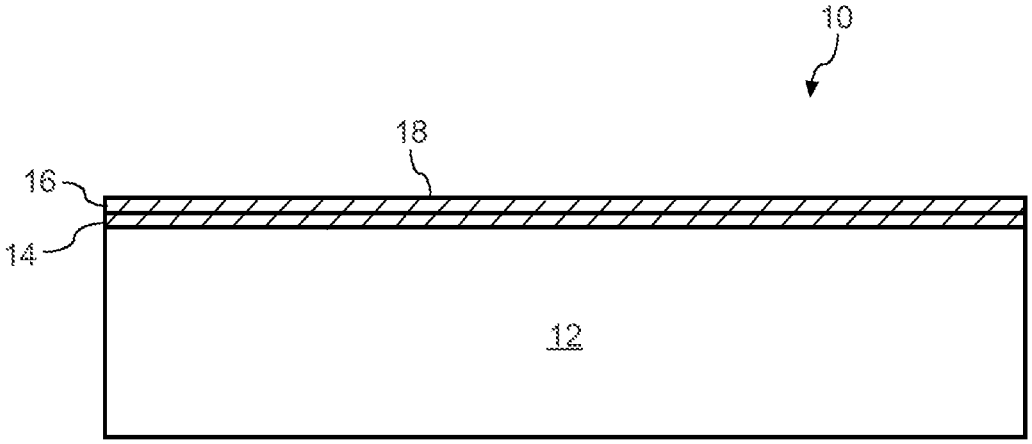
FIG. 1 is a cross-sectional view of one embodiment of a coated paper product made in accordance with the present disclosure.

Repeat use of reference characters in the present specification and drawings is intended to represent the same or analogous features or elements of the present invention.

Definitions

As used herein, a "coating" refers to a film formed on the surface of a cellulose layer. The coating can be a continuous coating or a discontinuous coating. The coating can cover the complete surface of the cellulose layer. In one aspect, no fibers of the cellulose layer are exposed to the outside after one or more coatings have been applied to the cellulose layer.

As used herein, the "moisture vapor transmission rate" (MVTR) is measured according to DIN EN ISO 15106-3: 2005-01 at a relative humidity of 50% and at a temperature of 23° C.

As used herein, the "oxygen transmission rate" (OTR) is measured according to DIN EN ISO Test 15105-2:2003 at a relative humidity of 50% and at a temperature of 23° C.

As used herein, the term "biomass" is broadly understood as encompassing all kinds of plant and animal material and material derived from the same. "Plant or animal derived components" as understood herein can be obtained from biomass. Biomass and plant or animal derived components as used herein do not include petroleum or petroleum-derived products.

The biomass for use in the present invention may comprise macromolecular compounds, examples of which are lignin and polysaccharides, such as starch, cellulose, hemicellulose commonly also referred to as polyose, glycogen, and alginate.

As will be appreciated, certain kinds of biomass may include both plant and animal-derived material. As examples, manure (dung), night soil and sewage sludge can be mentioned. While the biomass for use in the present invention is preferably plant biomass, i.e. biomass of or derived from plants, certain contents of animal biomass (i.e. biomass of or derived from animals) may be present therein. For instance, the biomass may contain up to 30% of animal biomass. According to a preferred embodiment, the biomass for use in the present disclosure, which is preferably plant biomass, contains more than 70 wt %, most preferably more than 90 wt %, of polysaccharides and lignines in terms of the solid contents of the biomass.

For instance, the plant biomass may be agricultural plant material (e.g. agricultural wastes) or all kinds of wood material.

Without limitation, examples of biomass are crop, agricultural food and waste, feed crop residues, wood (such as wood flour, wood waste, scrap wood, sawdust, chips and discards), straw (including rice straw), grass, leaves, chaff, and bagasse. Furthermore, industrial and municipal wastes, including waste paper can be exemplified.

The term "biomass" as used herein preferably also includes monosaccharides such as glucose, ribose, xylose, arabinose, mannose, galactose, fructose, sorbose, fucose and rhamnose, as well as oligosaccharides.

The plant and animal derived components as used herein further include plant or animal derived proteins, such as milk protein.

As used herein, a "biodegradable" component is a component that is capable of being decomposed by living organisms, such as bacteria or fungi. A biodegradable component can thus be decomposed by the action of microorganisms such as bacteria or fungi with or without oxygen. In one aspect, a biodegradable component fulfills the requirements of at least one of the international industrial standards ISO Test 17088, EN Test 13432:2001, EN Test 14995, and/or ASTM Test 6400.

As used herein, the term "compostable" refers to components that can disintegrate into non-toxic, natural elements and includes industrial- and home-compostable components. Compostable components, for instance, can degrade at a rate consistent with similar organic materials. Compostable components degrade when exposed to microorganisms, humidity, and/or heat to yield a finished compost product. Coated papers made according to the present disclosure can be formulated to meet European standard EN Test 13432:2001 that defines the requirements for industrially compostable components.

The term "water-soluble" as used herein means that the component dissolves well in water, preferably, at 25° C. and 1 bar, at least 50 g/L, more preferably at least 100 g/L, and even more preferably at least 150 g/L, and most preferably at least 250 g/L of a component are dissolved in water.

The term "water-dispersible" as used herein means that for instance by stirring or homogenizing, particles of a component can be dispersed in water, i.e. uniformly and finely distributed in water, so that they preferably have a particle size of no more than 1 μm.

The term "pulp" as used herein refers to fibers from natural sources such as woody and non-woody plants. Woody plants include, for example, deciduous and coniferous trees. Non-woody plants include, for example, cotton, flax, esparto grass, milkweed, straw, jute, hemp, and bagasse. Pulp fibers can include hardwood fibers, softwood fibers, and mixtures thereof.

The term "average fiber length" as used herein refers to an average length of fibers, fiber bundles and/or fiber-like materials determined by measurement utilizing microscopic techniques. A sample of at least 20 randomly selected fibers is separated from a liquid suspension of fibers. The fibers are set up on a microscope slide prepared to suspend the fibers in water. A tinting dye is added to the suspended fibers to color cellulose-containing fibers so they may be distinguished or separated from synthetic fibers. The slide is placed under a Fisher Stereomaster II Microscope—S19642/S19643 Series. Measurements of 20 fibers in the sample are made at 20× linear magnification utilizing a 0-20 mils scale and an average length, minimum and maximum length, and a deviation or coefficient of variation are calculated. In some cases, the average fiber length will be calculated as a weighted average length of fibers (e.g., fibers, fiber bundles, fiber-like materials) determined by equipment such as, for example, a Kajaani fiber analyzer Model No. FS-200, available from Kajaani Oy Electronics, Kajaani, Finland. According to a standard test procedure, a sample is treated with a macerating liquid to ensure that no fiber bundles or shives are present. Each sample is disintegrated into hot water and diluted to an approximately 0.001% suspension. Individual test samples are drawn in approximately 50 to 100 ml portions from the dilute suspension when tested using the standard Kajaani fiber analysis test procedure. The weighted average fiber length may be an arithmetic average, a length weighted average or a weight weighted average and may be expressed by the following equation:

$$\sum_{x_i=0}^{k}(x_i * n_i)/n$$

where
k=maximum fiber length
x=fiber length
n=number of fibers having length xi
n=total number of fibers measured.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a coated paper having excellent barrier and heat seal properties. Of particular advantage, the coated paper of the present disclosure can be constructed entirely from sustainable materials. Thus, in one aspect, the coated paper can be not only biodegradable and/or compostable, and preferably home-compostable, but is also well suited to forming all different types of packaging, particularly non-rigid packaging.

Referring to FIG. 1, for instance, one embodiment of a coated paper 10 made in accordance with the present disclosure is shown. As illustrated, the coated paper 10 includes a cellulose layer 12 that is coated on one side with at least two different coating layers. In particular, the coated paper 10 includes a barrier coating 14 that can be applied directly to one surface of the cellulose layer 12. A heat-sealable coating 16 is applied over the barrier coating 14 on the same side of the cellulose layer 12.

As will be described in greater detail below, the barrier coating 14 is formed from a plant or animal derived component, which is preferably water-soluble or water-dispersible, and more preferably water-soluble. The barrier coating 14 provides barrier properties to the coated paper 10 and specifically provides low oxygen transmission rates.

The heat-sealable coating 16, on the other hand, is applied over the barrier coating 14 and protects the barrier coating 14. In particular, the heat-sealable coating 16 can protect the barrier coating 14 from exposure to moisture which, may cause the barrier coating 14 to degrade. In addition, the heat-sealable coating 16 further improves the barrier properties of the overall product and specifically provides low moisture vapor transmission rates. The heat-sealable coating 16 is also heat-sealable and therefore can be used to bond the coated paper to an adjacent coated paper for producing packages or other items where a hollow enclosure is desired.

The heat-sealable coating 16 can contain a wax, which is preferably a bio-based wax, alone or in combination with other components, such as a polymer. The polymer combined with the wax, for instance, can be a polyester polymer, a polysaccharide, a polysaccharide ester, a polysaccharide ether, a polysaccharide ether ester, a latex polymer or combinations thereof.

In one embodiment, the barrier coating 14 and the heat-sealable coating 16 can be applied to one side of the cellulose layer and a different coating can be applied to the opposite side. For instance, a print receptive coating that can better receive printed matter can be applied to the opposite side of the cellulose layer. The print receptive coating, for instance, can be a bio-based polymer layer optionally containing filler particles, such as clay particles. In still another aspect, the opposite side of the coated paper 10 can include a barrier coating and/or a heat-sealable coating. For instance, in one embodiment, each side of the cellulose layer 12 can include a barrier coating 14 positioned adjacent the surface of the cellulose layer and a heat-sealable coating 16 over each barrier coating.

The coated paper 10 as shown in FIG. 1 is not only biodegradable and/or compostable, and preferably home-compostable, but also has an excellent balance of properties. For instance, the coated paper 10 is flexible and has a Youngs Modulus well suited for packaging applications. In addition, the coated paper 10 is strong and tear resistant. For example, the tensile strength of the coated paper in the machine direction can be equal to or greater than about 50 N/15 mm, preferably equal to or greater than about 55 N/15 mm, more preferably equal to or greater than about 60 N/15 mm, even more preferably equal to or greater than about 65 N/15 mm, even further more preferably equal to or greater than about 70 N/15 mm, most preferably equal to or greater than about 75 N/15 mm, and generally equal to or less than about 100 N/15 mm.

The coated paper 10 can also be constructed to have excellent barrier properties. For instance, the coated paper 10 can display a moisture vapor transmission rate (MVTR) of less than about 10 $g/m^2/24$ hours, preferably less than about 9 $g/m^2/24$ hours, more preferably less than about 8 $g/m^2/24$ hours, even more preferably less than about 7 $g/m^2/24$ hours, even further more preferably less than about 6 $g/m^2/24$ hours, even further more preferably less than about 5 $g/m^2/24$ hours, even further more preferably less than about 4 $g/m^2/24$ hours, even further more preferably less than about 3 $g/m^2/24$ hours, even further more preferably less than about 2 $g/m^2/24$ hours, most preferably less than about 1 $g/m^2/24$ hours. The coated paper 10 can also display excellent oxygen barrier properties. For instance, the coated paper 10 can display an oxygen transmission rate (OTR) of less than about 2 $cm^3/m^2/24$ hours, preferably less than about 1.75 $cm^3/m^2/24$ hours, more preferably less than about 1.5 $cm^3/m^2/24$ hours, even more preferably less than about 1.25 $cm^3/m^2/24$ hours, even further more preferably less than about 1 $cm^3/m^2/24$ hours, even further more preferably less than about 0.75 $cm^3/m^2/24$ hours, even further more preferably less than about 0.5 $cm^3/m^2/24$ hours, most preferably less than about 0.25 $cm^3/m^2/24$ hours.

The coated paper 10 can also define an exterior surface 18 as shown in FIG. 1 that is a heat-sealable surface. The surface 18, for instance, can be formulated to be not sticky at room temperature. The surface 18 or heat-sealable coating 16 can produce a heat seal at a temperature of greater than about 100° C., such as greater than about 110° C., such as greater than about 120° C., such as greater than about 130° C., such as greater than about 140° C., such as greater than about 150° C., such as greater than about 160° C., such as greater than about 170° C., such as greater than about 180° C., and less than about 250° C., such as less than about 230° C., such as less than about 220° C., such as less than about 210° C., such as less than about 200° C., such as less than about 190° C., such as less than about 180° C. Of particular advantage, the coating displays excellent heat-sealability even at a relatively low basis weight.

Figure 2:
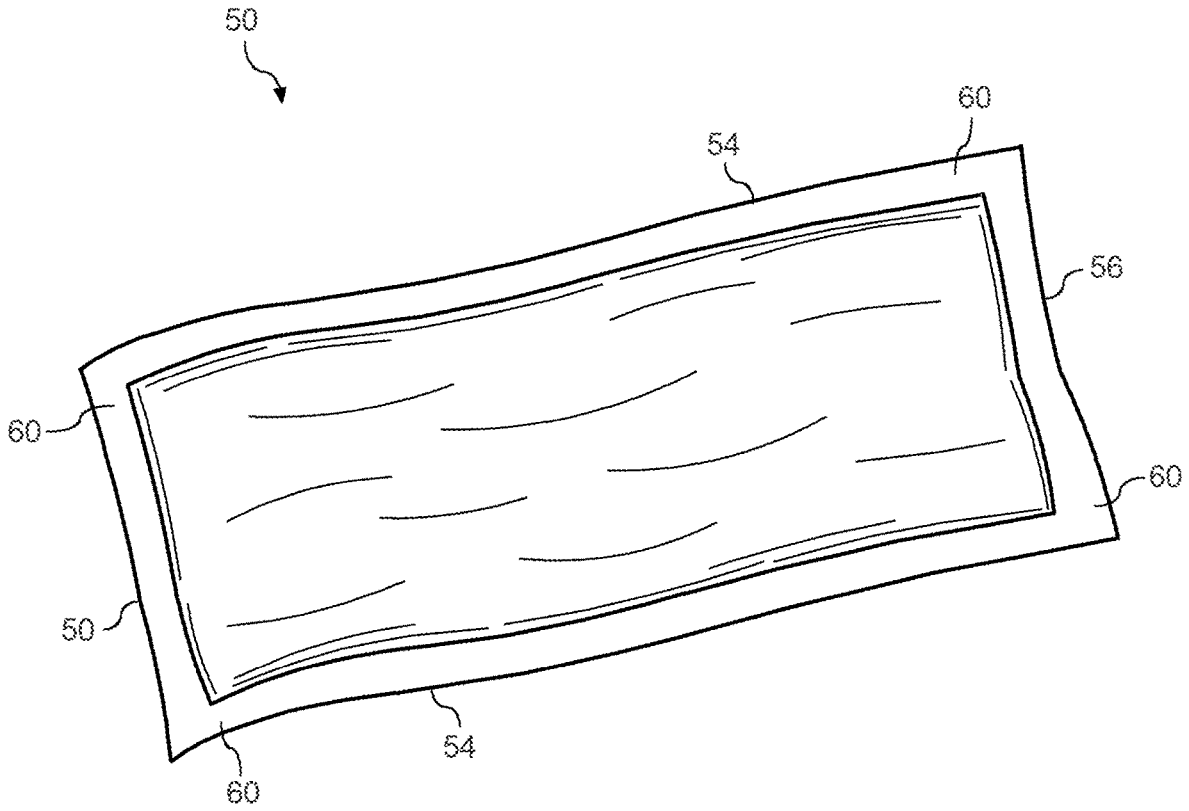
FIG. 2 is a perspective view of one embodiment of a package made in accordance with the present disclosure.

The coated paper 10 as shown in FIG. 1 can be used to form various different packages using different techniques and processes. For exemplary purposes, referring to FIG. 2, a package 50 that may be formed in accordance with the present disclosure is shown. The package 50 can be made from the coated paper 10 as shown in FIG. 1. The package 50 includes a bottom 52, sides 54, and a top 56. The package 50, in this embodiment, is formed from two opposing coated paper layers made in accordance with the present disclosure. Each side of the package can be made from an individual piece or sheet of the coated paper or can be formed by folding the coated paper in an overlapping relationship. The heat-sealable coating 16 on the coated paper 10 can be used to seal the margins of the package 50. For instance, as shown in FIG. 2, the package 50 includes sealed margins 60 formed by bonding adjacent heat-sealable coatings together. The margins can be formed, for instance, by applying heat and pressure to the heat-sealable coating 16. In other embodiments, however, various other forms of energy can be used to form the sealed margins. For instance, ultrasonic energy can also be used.

The package 50 as shown in FIG. 2 can include a hollow enclosure for containing numerous different items. Because the coated paper is made from sustainable, biodegradable, and/or compostable materials, preferably home-compostable materials, the coated paper is well suited for contact with foods. Thus, in one embodiment, the package 50 can be designed to contain a food product, such as snack foods. The package can also contain various other items, including hardware, consumer products, or the like.

In one embodiment, when filling packages 50 as shown in FIG. 2, two of the coated paper layers can be brought together and sealed at the margins to produce a hollow interior with a volume. A product or products can then be loaded into the hollow interior and the remaining side of the package can be sealed. In order to seal the package, the open end of the package can be engaged with a sealing device that applies heat and pressure in an amount sufficient for a heat-sealable coating to activate and form thermal bonds with an opposing heat-sealable coating.

As described above, the coated paper can include a barrier coating applied directly to one side of the cellulose layer. In accordance with the present disclosure, the barrier coating can dramatically improve the barrier properties of the coated paper, and specifically provides low oxygen transmission rates, while being completely biodegradable and/or compostable, preferably home-compostable.

In one embodiment, the barrier coating is formed from a plant or animal derived component. The plant or animal derived components for use in the present invention do not include petroleum or petroleum-derived products. The plant or animal derived component for use in the barrier coating is preferably water-soluble or water-dispersible, and more preferably water-soluble. By being water-soluble or water-dispersible, the plant or animal derived component can be easily applied to the cellulose layer and dried. In one aspect, the plant or animal derived component is amorphous.

Examples of the plant or animal derived component for use in the barrier coating include plant or animal derived proteins, such as milk protein, and polysaccharides, such as alginate, cellulose-based materials or modified starch. Suitable cellulose-based materials are nanofibrillated cellulose (NFC), microfibrillated cellulose (MFC), nanocrystalline cellulose (NCC) or microcrystalline cellulose (MCC). In one preferred embodiment, the plant or animal derived component is an animal derived protein, and more preferably milk protein. The milk protein for use in the barrier coating may contain minor amounts of residual lactic acid.

In an embodiment, the barrier coating does not comprise a saccharide fatty acid ester. As meant herein, a saccharide fatty acid ester includes fatty acid esters of all saccharides, including mono-, di- and trisaccharides, including that the fatty acid moieties in the saccharide fatty acid ester may be saturated, unsaturated or a combination thereof.

The barrier coating can only contain the above-described plant or animal derived component or can in addition thereto also contain various other components. For instance, the barrier coating can contain a biodegradable and/or compostable polymer and/or a biodegradable and/or compostable filler. In one aspect, for instance, the barrier coating can contain the plant or animal derived component combined with a polyvinyl alcohol polymer. The polyvinyl alcohol polymer can be synthesized from polyvinyl acetate and can be formed into different products that vary in molecular weight and hydrolysis level. Polyvinyl alcohol particularly well suited for incorporation into the barrier coating can have a relatively high hydrolysis level, such as greater than about 90%, such as greater than about 92%, such as greater than about 94%, such as greater than about 96%, such as greater than about 98%. The hydrolysis level can be less than about 100%, such as less than about 99.5%, such as less than about 99%. The viscosity of the polyvinyl alcohol can generally be less than about 50 cPs, such as less than about 40 cPs, such as less than about 35 cPs, and generally greater than about 10 cPs, such as greater than about 15 cPs, such as greater than about 20 cPs, such as greater than about 25 cPs. The viscosity of the polyvinyl alcohol can be determined according to DIN Test 53019, in particular according to DIN 53019-1:2008-09. The viscosity can be measured using a Brookfield viscosimeter.

In an embodiment, the barrier coating consists of the plant or animal derived component and polyvinyl alcohol polymer and optionally a filler. The polyvinyl alcohol polymer may be as specified above. The filler for optional use is not further specified. For instance, apart from the cellulose filler described below, the filler may also be an inorganic filler, for example kaolinite (kaolin) and/or talc (talcum). Within this embodiment, the barrier coating preferably consists of 10 wt.-% to 50 wt.-%, such as 10 wt.-% to 20 wt.-%, of the plant or animal derived component, preferably milk protein, and polyvinyl alcohol polymer in an amount adding up to 100 wt.-%, i.e., polyvinyl alcohol polymer forms the remainder of the barrier coating.

The presence of polyvinyl alcohol within the barrier coating is optional. When present, however, the polyvinyl alcohol can be included in an amount equal to or greater than about 3 wt.-%, such as in an amount equal to or greater than about 5 wt.-%, such as in an amount equal to or greater than about 8 wt.-%, such as in an amount equal to or greater than about 10 wt.-%, such as in an amount equal to or greater than about 15 wt.-%, such as in an amount equal to or greater than about 20 wt.-%, such as in an amount equal to or greater than about 25 wt.-%, such as in an amount equal to or greater than about 30 wt.-%, and generally in an amount equal to or less than about 60 wt.-%, such as in an amount equal to or less than about 40 wt.-%, such as in an amount equal to or less than about 20 wt.-%, such as in an amount equal to or less than about 10 wt.-% based upon the dry weight of the barrier coating. In a preferred embodiment, the barrier coating comprises milk protein and a polyvinyl alcohol polymer. More preferably the barrier coating comprises 50 to 80 wt.-% of milk protein and 20 to 50 wt.-% of polyvinyl alcohol polymer, and even more preferably 55 to 75 wt.-% of milk protein and 25 to 45 wt.-% of polyvinyl alcohol polymer, and even more preferably 60 to 70 wt.-% of milk protein and 30 to 40 wt.-% of polyvinyl alcohol polymer, based on the total weight of the barrier coating.

In addition to a polymer, the barrier coating can also contain a filler, especially a biodegradable and/or compostable filler. In one embodiment, for instance, the barrier coating can contain a cellulose filler, such as a microcrystalline cellulose, a nanocrystalline cellulose, or the like. The filler, such as the cellulose filler, can generally be present in the barrier coating in amounts equal to or less than about 20 wt.-%, such as in amounts equal to or less than about 15 wt.-%, such as in amounts equal to or less than about 10 wt.-%, such as in amounts equal to or less than about 8 wt.-%, such as in amounts equal to or less than about 5 wt.-%, based on the total weight of the barrier coating. The filler, such as the cellulose filler can be present in the barrier coating generally in an amount equal to or greater than about 0.1 wt.-%, such as in an amount equal to or greater than about 1 wt.-%, such as in an amount equal to or greater than about 2 wt.-%, such as in an amount equal to or greater than about 5 wt.-%, based on the total weight of the barrier coating.

The barrier coating forms a coating primarily on the surface of the cellulose layer but can also impregnate the cellulose layer. For instance, the barrier coating can extend greater than about 3%, such as greater than about 5%, such as greater than about 10%, such as greater than about 20%, such as greater than about 30%, such as greater than about 40%, such as greater than about 50%, such as greater than about 60% of the thickness of the cellulose layer. The barrier coating can extend less than about 70%, such as less than about 50%, such as less than about 30%, such as less than about 20%, such as less than about 10% into the thickness of the cellulose layer. The amount the barrier coating penetrates the thickness of the cellulose layer can depend upon numerous factors, including the viscosity of the barrier coating when applied and the porosity of the cellulose layer.

The basis weight of the barrier layer can also vary depending upon the particular application and various factors including the end use application of the coated paper, the basis weight of the cellulose layer, and the like. In one aspect, the barrier coating can have a basis weight of from about 8 $g/m^2$ to about 30 $g/m^2$, including all increments of 1 $g/m^2$ therebetween. For instance, the basis weight of the barrier coating can be equal to or greater than about 10 $g/m^2$, such as equal to or greater than about 12 $g/m^2$, such as equal to or greater than about 14 $g/m^2$, such as equal to or greater than about 16 $g/m^2$, such as equal to or greater than about 18 $g/m^2$, and can be equal to or less than about 25 $g/m^2$, such as equal to or less than about 23 $g/m^2$, such as equal to or less than about 20 $g/m^2$, such as equal to or less than about 18 $g/m^2$, such as equal to or less than about 16 $g/m^2$, such as equal to or less than about 15 $g/m^2$.

As described above, the barrier coating applied to the cellulose layer is covered with a heat-sealable coating. The heat-sealable coating can be applied directly to the barrier coating and can be incorporated into the coated paper without any type of adhesive or tie layer between the barrier coating and the heat-sealable coating. In fact, the coated paper of the present disclosure can be made without any adhesive layers between any of the coatings or between the cellulose layer and the coating.

The heat-sealable coating generally contains a wax. The wax is preferably a bio-based wax, which can, for instance, be produced from a biomass resource. In addition to providing heat-sealable properties, the wax results in improved hydrophobicity, improved slip properties and improved non-abrasive properties of the coated paper. The heat-sealable coating also enhances surface and barrier characteristics, and specifically provides low moisture vapor transmission rates.

The wax may preferably be a plant wax or an animal wax and is more preferably a plant wax.

Animal waxes typically include wax esters derived from a variety of fatty acids and carboxylic alcohols. The animal wax may be a wax selected from the group of insect secreted waxes, spermaceti and lanolin.

The insect wax is preferably beeswax. A major component of beeswax is myricyl palmitate which is an ester of triacontanol and palmitic acid. The melting temperature of beeswax is in the range of 60 to 65° C. Spermaceti occurs in large amounts in the head oil of the sperm whale. Spermaceti comprises cetyl palmitate as a main constituent. Lanolin is a wax obtained from wool and comprises esters of sterols.

Plant waxes are complex mixtures of hydrocarbons, alcohols, aldehydes, ketones, esters, acids, and combinations of these that are deposited in a layer outside the epidermal cells. Plant waxes are generally water-repellent components found in an amorphous layer on the outer surface of plants. Plant waxes within the meaning of the present invention also comprise waxes obtained from plant oils or vegetable oils by chemical reactions such as hydrogenation.

The plant wax may be more preferably one or more selected from the group consisting of candelilla wax, carnauba wax, rice bran wax, soy wax, sugar cane wax, sunflower wax, pea wax, coconut wax and palm tree wax, and even more preferably soy wax.

Candelilla wax is mainly obtained from the leaves of the plant *Euphorbia antisyphilitica* Zuccarini. Unpurified candelilla wax contains approximately 40-45 wt.-% hydrocarbons, 35-45 wt.-% wax, resin and sitosteroyl esters, 5-10 wt.-% free wax and resin acids, 4-8 wt.-% lactones, and 2-8 wt.-% free wax and resin alcohols.

Carnauba wax is mainly obtained from the Brazilian palm *Coernicia cerifera* Martius, also known as carnauba wax palm. It is found on the upper and lower surface of the palm leaves. Carnauba wax contains a high proportion of unesterified alcohols, x-hydroxy esters and esters of hydroxylated cinnamic acid. Carnauba wax is one the hardest plant waxes and has a melting temperature of about 80° C.

Rice bran wax is another high melting wax found in husks of rice *Oryza sativa*. It is obtained as a by-product from the de-waxing of rice bran oil. The major components of rice bran wax are even-numbered aliphatic acids and higher alcohol esters. Other constitutes include free fatty acids (palmitic acid), phospholipids, phytosterols and squalene. The hydrocarbon content of rice bran wax is typically as low as 2 wt.-%.

Sunflower wax is found in the seed and seed hulls of *Helianthus annuus* (sunflower). It is obtained through the winterization of sunflower oil. Sunflower wax is a hard, high melting wax mainly consisting of long chain saturated fatty esters.

Soy wax can be obtained by hydrogenation of soybean oil. It is a triglyceride, containing a high proportion of stearic acid. It is typically softer than paraffin wax and has a lower melting temperature compared to paraffin wax. Its melting point is in the range from about 50° C. to about 80° C.

Sugarcane wax is indigestible and harmless to health. In its refined form it has a light yellowish color. Due to the high melting point of 75 to 80° C., it remains stable even if exposed to direct sunlight. Sugarcane wax offers a good oil and solvent retention for anionic bright emulsions.

The wax used in the present invention is preferably one or more waxes selected from the group consisting of rice bran wax, soy wax, sugar cane wax, and beeswax, and more preferably soy wax The wax has preferably a dropping point in the range of 60° ° C. to 120° C., and more preferably in the range of 60 to 110° C. The dropping point is a characteristic property of a wax. For determining the dropping point, samples are heated until they transform from a solid into a liquid state. Specifically, the dropping point is the temperature at which the first drop of a molten substance precipitates from a standardized cup with a defined orifice under controlled testing conditions in a furnace. In the present invention, the dropping point may be determined according to the procedure described in DIN ISO 2176:1997-05.

The heat-sealable coating used in the present invention may preferably comprise 10 to 90 wt.-% of the wax, more preferably 10 to 80 wt.-% of the wax, even more preferably 10 to 60 wt.-% of the wax, and most preferably 10 to 40 wt.-% of the wax based on the total weight of the heat-sealable coating. In addition to a wax, the heat-sealable coating can also optionally contain a polymer and various other components. The polymer to be used in the heat-sealable coating can be a polymer selected from the group consisting of polyester, polysaccharide, polysaccharide ether, polysaccharide ester polysaccharide ether ester and latex polymer. Combining a polymer as described above with the wax, for instance, can improve the heat-sealable properties of the heat-sealable coating. In addition, the above polymers can completely replace petroleum-derived heat-sealable polymers used in the past. The polymers above, for instance, can be produced from biomass. Thus, the polymers can be sustainable and environmentally friendly, just like the bio-based wax, and exhibit excellent heat-sealable properties. If a home-compostable paper is desired, the heat-sealable coating does not comprise a latex polymer.

The polymer is preferably a thermoplastic polymer. If the polymer is a thermoplastic polymer, the heat-sealability is further improved.

The polymer is preferably a thermoplastic polymer with a melting point in the range of 60 to 200° C., more preferably 100 to 180° C., and most preferably 110 to 180° C. When the heat sealable coating of the coated paper of the present disclosure comprises a thermoplastic polymer having a melting point in the range of 60 to 200° C., the heat-sealability of the coated paper is improved. The heat-sealability is even further improved when the coating of the coated paper of the present invention comprises a thermoplastic polymer having a melting point in the range of 100 to 180° C.

In addition, the polymer is preferably a biomass-based polymer, so that the coated paper is more sustainable and environmentally friendly.

The polyester may be selected from the group consisting of polyhydroxyalkanoate, polylactic acid, polyglycolic acid, polybutylene succinate, polycaprolactone, polybutylene adipate terephthalate, and polylactic acid-polyethylene glycol.

Polyhydroxyalkanoates (PHAs) are polyesters of hydroxyalkanoic acids. Polyhydroxyalkanoates (PHAs) are thermoplastic. They may be homopolyesters or copolyesters and differ in their properties according to their chemical composition, namely the contained hydroxyalkanoic acid(s).

The PHA may be one or more polyester selected from the group consisting of poly(3-hydroxypropionate), poly(3-hydroxybutyrate), poly(4-hydroxybutyrate), poly(3-hydroxyvalerate), poly(3-hydroxyhexanoate), poly(3-hydroxyheptanoate), poly(3-hydroxyoctanoate), poly(3-hydroxynonanoate), poly(3-hydroxydecanoate), poly(3-hydroxyundecanoate), poly(3-hydroxydodecanoate), poly (3-hydroxytetradecanoate), poly(3-hydroxypentadecanoate), and poly(3-hydroxyhexadecanoate). The PHA may also be one or more copolyester obtained from copolymerization of two or more hydroxyalkanoic acids. More particularly, the PHA copolyester may be one or more selected from the group consisting of poly(3-hydroxypropionate-co-3-hydroxybutyrate), poly (3-hydroxypropionate-co-4-hydroxybutyrate), poly(3-hydroxybutyrate-co-4-hydroxybutyrate), poly(3-hydroxybutyrate-co-3-hydroxyvalerate), poly(3-hydroxybutyrate-3-hydroxyhexanoate), and poly(3-hydroxybutyrate-co-3-hydroxyvalerate-co-3-hydroxyhexanoate).

The PHA is preferably one or more polyester selected from the group consisting of poly(3-hydroxypropionate), poly(3-hydroxybutyrate), poly(4-hydroxybutyrate), poly(3-hydroxyvalerate), poly(3-hydroxybutyrate-co-4-hydroxybutyrate), poly(3-hydroxybutyrate-3-hydroxyhexanoate), and poly(3-hydroxybutyrate-co-3-hydroxyvalerate). The PHA is most preferably poly(3-hydroxybutyrate).

The polybutylene adipate terephthalate is preferably a block copolymer. The polylactic acid-polyethylene glycol is preferably a block copolymer.

The polysaccharide may be one or more selected from the group consisting of starch, cellulose, arabinoxylan, chitin, and pectin. The polysaccharide is preferably starch or cellulose.

A plasticizer may be added to the polysaccharide, in order to improve the thermoplastic properties of the polysaccharide. Thus, a thermoplastic polysaccharide comprising a polysaccharide and a plasticizer is obtained.

The plasticizer may be one or more compound(s) selected from the group consisting of polyhydric alcohols, diols, esters of polyhydric alcohols and aliphatic esters of mono-, di- or polycarboxylic acids. The plasticizer is preferably a polyhydric alcohol or a diol and most preferably one or more compound(s) selected from glycerol, glycol, and sorbitol. The glycerin may be vegetable glycerin (VG). Vegetable glycerin is glycerin obtained from plant oils such as soybean oil, coconut oil or palm oil.

The thermoplastic polysaccharide preferably comprises at least one of starch and cellulose. In other words, the thermoplastic polysaccharide is preferably thermoplastic starch, thermoplastic cellulose or a combination thereof, and more preferably thermoplastic starch. The thermoplastic starch preferably comprises one or more plasticizer selected from the group consisting of glycerol, glycol, and sorbitol.

In one aspect, the thermoplastic polysaccharide is derived from agricultural waste from corn.

The polymer used in the heat-sealable coating of the present invention may also be a polysaccharide ether, a polysaccharide ester or a polysaccharide ether ester.

The polysaccharide ether is preferably a cellulose ether. The polysaccharide ether is more preferably carboxymethyl cellulose, methyl cellulose, ethyl cellulose, hydroxyethyl cellulose, hydroxypropyl cellulose, ethyl methyl cellulose, and hydroxypropyl methyl cellulose. The polysaccharide ether is most preferably carboxymethyl cellulose, methyl cellulose, and hydroxyethyl cellulose.

The polysaccharide ester may be a cellulose ester such as cellulose acetate.

The polysaccharide ether ester may be a cellulose ether ester such as hydroxypropyl methyl cellulose acetate succinate and carboxymethyl cellulose acetate butyrate.

The polymer is most preferably one or more selected from the group consisting of poly(3-hydroxybutyrate), poly(4-hydroxybutyrate), polylactic acid, polylactic acid-polyethylene glycol block copolymer, polybutylene adipate terephthalate and thermoplastic starch.

The heat-sealable coating can contain one or more of the above polymers generally in an amount equal to or greater than about 10 wt.-%, preferably an amount equal to or greater than about 20 wt.-%, more preferably in an amount equal to or greater than about 30 wt.-%, even more preferably in an amount equal to or greater than about 40 wt.-%, most preferably in an amount equal to or greater than about 50 wt.-%, based on the total weight of the heat-sealable coating. One or more polymers as described above can be present in the heat-sealable coating generally in an amount equal to or less than about 90 wt.-%, preferably in an amount equal to or less than about 80 wt.-%, more preferably in an amount equal to or less than about 70 wt.-%, most preferably in an amount equal to or less than about 60 wt.-%, based on the total weight of the heat-sealable coating.

The heat-sealable coating used in the present invention may preferably comprise 10 to 90 wt.-% of the wax and 10 to 90 wt.-% of the polymer and may more preferably comprise 10 to 40 wt.-% of the wax and 60 to 90 wt.-% of the polymer, based on the total weight of the heat-sealable coating. In addition, a paper coated with a heat-sealable coating comprising 10 to 90 wt.-% of the wax and 10 to 90 wt.-% of the polymer, based on the total weight of the heat-sealable coating, combines a paper-like look and feel with a workability and heat-sealability comparable to a plastic film. The heat-sealability of the coated paper is further improved when the heat-sealable coating comprises 10 to 40 wt.-% of the wax and 60 to 90 wt.-% of the polymer, based on the total weight of the heat-sealable coating. In addition, a coated paper with a heat-sealable coating comprises 10 to 40 wt.-% of the wax and 60 to 90 wt.-% of the polymer, based on the total weight of the heat-sealable coating, exhibits improved water-vapor barrier properties. In a particularly preferable embodiment, the heat-sealable coating comprises 20 to 40 wt.-% of the wax and 60 to 80 wt.-% of the polymer, based on the total weight of the heat-sealable coating. In such coating, the best compromise between moisture vapor barrier properties and heat-sealability is achieved.

The heat-sealable coating used in the present invention may preferably comprise a soy wax and thermoplastic polysaccharide that is preferably derived from agricultural waste from corn.

The heat-sealable coating used in the present disclosure may comprise one or more additives. The additive may be at least one compound selected from the group consisting of a rheology modifier and a softener.

The rheology modifier is preferably one or more compound selected from the group consisting of cellulose, starch or a derivative thereof. The rheology modifier is preferably water-soluble or water-dispersible. The rheology modifier is more preferably biomass-based and/or biodegradable. The rheology modifier allows to thicken the emulsion and to improve emulsion stability. Thus, dripping during application of the coating can be avoided.

The use of a rheology modifier selected from the group consisting of cellulose, starch and a derivative thereof improves the emulsion stability of the heat-sealable coating. At the same time, such rheology modifier is sustainable because it is water-soluble or water-dispersible, biomass-based and bio-degradable. Thus, a sustainable and more environmentally friendly heat-sealable coated paper, which is suitable for the use as a packaging material and which has the desired, preferably paper-like, look and feel can be obtained.

The cellulose may be ultrafine cellulose, preferably powdered ultrafine cellulose such as ARBOCEL produced by JRS.

The cellulose derivative may be a cellulose ether or a cellulose ether ester. The cellulose ether is preferably carboxymethyl cellulose, methyl cellulose, ethyl cellulose, hydroxyethyl cellulose, hydroxypropyl cellulose, ethyl methyl cellulose, and hydroxypropyl methyl cellulose. The cellulose ether is more preferably carboxymethyl cellulose, methyl cellulose, and hydroxyethyl cellulose. The hydroxyethyl cellulose may for example be Cellosize™ QP-100 produced by Dow. The cellulose ether ester may be hydroxypropyl methyl cellulose acetate succinate and carboxymethyl cellulose acetate butyrate.

The starch derivative may for example be phosphated distarch phosphate, preferably phosphated distarch phosphate based on waxy corn such as AGENAJEL 20.350 produced by AGRANA STÄRKE.

The heat-sealable coating can comprise 0 to 3 wt.-%, and more preferably 0.5 to 2 wt.-% of rheology modifier, based on the total weight of the heat-sealable coating.

The heat-sealable coating of the present disclosure may also contain a softener. The softener may be one or more compound(s) selected from the group consisting of polyhydric alcohols, diols, esters of polyhydric alcohols and aliphatic esters of mono-, di- or polycarboxylic acids. The softener is preferably a polyhydric alcohol or a diol and most preferably one or more compound(s) selected from glycerol, glycol, and sorbitol. The glycerin may be vegetable glycerin (VG). Vegetable glycerin is glycerin obtained from plant oils such as soybean oil, coconut oil or palm oil.

The addition of a softener further improves the workability of the coating and the heat-sealability of the coated paper.

Glycerol, glycol, and sorbitol are water-soluble, biodegradable and can be produced from biomass. Therefore, a coating comprising a softener selected from the group consisting of glycerol, glycol, and sorbitol is sustainable and environmentally friendly.

The heat-sealable coating preferably comprises 0 to 10 wt.-%, and more preferably 2 to 7 wt.-% of the softener, based on the total weight of the heat-sealable coating.

In still another aspect, the heat-sealable coating can contain a filler. The filler contained in the heat-sealable coating may be an inorganic filler. The filler is preferably a filler based on naturally occurring raw materials such as clay, for reasons of sustainability and environmental protection. The filler is even more preferably a clay mineral and most preferably a layered silicate mineral such as kaolinite. The filler may also be a pigment and more preferably a pigment based on naturally occurring raw materials such as clay, preferably a layered silicate mineral such as kaolinite.

The pigment may have a steep particle size distribution. In a most preferred embodiment, 90 wt.-% of the pigment particles have a particle size of less than 5 μm. Such a particle size distribution results in improved print and sheet gloss. For example, a high brightness coating pigment such as CAPIM DG slurry from Capim Kaolin may be used. The good rheological properties of a slurry of pigment particles with the above-described particle size distribution allows for high-speed application of the filler, for example in high-speed blade and metered size press applications.

The heat-sealable coating preferably comprises 0 to 20 wt.-%, and more preferably 3 to 15 wt.-% of the filler, based on the total weight of the heat-sealable coating.

In a preferred embodiment, the heat-sealable coating comprises 10 to 90 wt.-% of the polymer, 10 to 90 wt.-% of the wax, 0 to 3 wt.-% of rheology modifier, 0 to 10 wt.-% of softener and 0 to 20% of a filler, based on the total weight of the heat-sealable coating. In a more preferred embodiment, the heat-sealable coating comprises 60 to 90 wt.-% of the polymer, 10 to 40 wt.-% of the wax, 0 to 3 wt.-% of rheology modifier, 0 to 10 wt.-% of softener and 0 to 20% of a filler, based on the total weight of the heat-sealable coating. In an even more preferred embodiment, the heat-sealable coating consists of 60 to 90 wt.-% of the polymer, 10 to 40 wt.-% of the wax, 0 to 3 wt.-% of rheology modifier, 0 to 10 wt.-% of softener and 0 to 20% of a filler. In a most preferred embodiment, the heat-sealable coating consists of 60 to 80 wt.-% of the polymer, 20 to 40 wt.-% of the wax, 0 to 3 wt.-% of rheology modifier, 0 to 10 wt.-% of softener and 0 to 20% of a filler. If a home-compostable paper is desired, the heat-sealable coating does not comprise a latex polymer.

The basis weight of the heat-sealable coating can vary depending upon the particular application and the end use of the coated paper. In general, the basis weight of the heat-sealable coating can be from about 1 g/m$^2$ to about 25 g/m$^2$, including all increments of 1 g/m$^2$ therebetween. For instance, the heat sealable coating can have a basis weight of equal to or greater than about 3 g/m$^2$, such as equal to or greater than about 4 g/m$^2$, such as equal to or greater than about 5 g/m$^2$, such as equal to or greater than about 6 g/m$^2$, such as equal to or greater than about 7 g/m$^2$, such as equal to or greater than about 8 g/m$^2$. The basis weight of the heat-sealable coating can be equal to or less than about 25 g/m$^2$, such as equal to or less than about 23 g/m$^2$, such as equal to or less than about 20 g/m$^2$, such as equal to or less than about 18 g/m$^2$, such as equal to or less than about 15 g/m$^2$, such as equal to or less than about 14 g/m$^2$.

The coated paper of the present disclosure preferably comprises a barrier coating which comprises a milk protein alone or in combination with a polyvinyl alcohol polymer and a heat-sealable coating which comprises vegetable wax, such as soy wax, and thermoplastic polysaccharide that is preferably derived from agricultural waste from corn. More preferably the barrier coating comprises 50 to 80 wt.-% of milk protein and 20 to 50 wt.-% of polyvinyl alcohol polymer, and even more preferably 55 to 75 wt.-% of milk protein and 25 to 45 wt.-% of polyvinyl alcohol polymer, and even more preferably 60 to 70 wt.-% of milk protein and 30 to 40 wt.-% of polyvinyl alcohol polymer, based on the total weight of the barrier coating.

The basis weight of the barrier coating comprising the milk protein is preferably from 2 to 20 g/m$^2$, more preferably from 3 to 15 g/m$^2$, and even more preferably from 7 to 12 g/m$^2$. The basis weight of the heat-sealable coating comprising a vegetable wax and thermoplastic polysaccharide that is preferably derived from agricultural waste from corn is preferably from 2 to 20 g/m$^2$, more preferably from 3 to 15 g/m$^2$, and even more preferably from 4 to 14 g/m$^2$.

As described above, the barrier coating and the heat-sealable coating are both applied to a cellulose layer. The cellulose layer, for instance, can be made from various different cellulose fibers. In general, the cellulose layer can have a basis weight of from about 20 g/m$^2$ to about 200 g/m$^2$, including all increments of 1 g/m$^2$ therebetween. For instance, the cellulose layer can have a basis weight of equal to or greater than about 25 g/m$^2$, such as equal to or greater than about 30 g/m$^2$, such as equal to or greater than about 40 g/m$^2$, such as equal to or greater than about 50 g/m$^2$, such as equal to or greater than about 60 g/m$^2$, such as equal to or greater than about 70 g/m$^2$. The basis weight of the cellulose layer is generally equal to or less than about 200 g/m$^2$, such as equal to or less than about 120 g/m$^2$, such as equal to or less than about 110 g/m$^2$, such as equal to or less than about 100 g/m$^2$, such as equal to or less than about 90 g/m$^2$, such as equal to or less than about 80 g/m$^2$, such as equal to or less than about 70 g/m$^2$, such as equal to or less than about 60 g/m$^2$.

The cellulose layer has preferably a thickness of 35 to 200 μm, more preferably 40 to 160 μm. If the cellulose layer is not subjected to a step of compressing in the machine direction to obtain an extensible cellulose layer, the cellulose layer has even more preferably a thickness of 40 to 70 μm, and most preferably 50 to 60 μm. If the cellulose layer is subjected to a step of compressing in the machine direction, such as creping, the cellulose layer after compressing in machine direction has even more preferably a thickness of 60 to 150 μm, and most preferably of 60 to 120 μm.

The basis weight of the coated paper or entire product can generally be from about 21 g/m$^2$ to about 250 g/m$^2$, including all increments of 1 g/m$^2$ therebetween. For instance, the coated paper can have a basis weight of equal to or greater than about 30 g/m$^2$, such as equal to or greater than about 35 g/m$^2$, such as equal to or greater than about 40 g/m$^2$, such as equal to or greater than about 45 g/m$^2$, such as equal to or greater than about 50 g/m$^2$, such as equal to or greater than about 55 g/m$^2$, such as equal to or greater than about 60 g/m$^2$, such as equal to or greater than about 65 g/m$^2$. The basis weight of the coated paper can be generally equal to or less than about 150 g/m$^2$, such as equal to or less than about 125 g/m$^2$, such as equal to or less than about 100 g/m$^2$, such as equal to or less than about 95 g/m$^2$, such as equal to or less than about 90 g/m$^2$, such as equal to or less than about 85 g/m$^2$, such as equal to or less than about 80 g/m$^2$.

The basis weight of the cellulose layer and the basis weight of the coated paper are determined according to ISO 536:2019-11. The thickness of the cellulose layer and of the coated paper can be determined according to EN ISO 534:2012-02 with a compressive load of 1.0 bar.

The cellulose layer can be made from any suitable papermaking fibers. Fibers suitable for making the cellulose layer, for instance, include any natural or synthetic cellulosic fibers including, but not limited to, non-woody fibers, such as cotton, abaca, kenaf, sabai grass, flax, esparto grass, straw, jute hemp, bagasse, milkweed, flax fibers, and the like. In one aspect, the cellulose layer contains woody or pulp fibers such as those obtained from deciduous and coniferous trees. Such fibers can include softwood fibers, such as Northern and Southern softwood kraft fibers. Other fibers include hardwood fibers such as eucalyptus, maple, birch, and aspen fibers.

Other papermaking fibers that can be used include paper broke or recycled fibers and high yield fibers. High yield pulp fibers are those papermaking fibers produced by pulping processes providing a yield of about 65% or greater, such as from about 75% to about 95%. Such pulping processes include bleached chemithermomechanical pulp, chemithermomechanical pulp, other thermomechanical pulp, high yield sulfite pulps, and high yield kraft pulps.

In one particular embodiment, the cellulose layer is made from softwood fibers alone or in combination with hardwood fibers.

The cellulose layer may be extensible. When the cellulose layer is extensible, the coated paper can undergo large deformations in converting or end use applications.

When the cellulose layer is extensible, the coated paper of the present invention exhibits improved elongation and elasticity, especially in the machine direction. Thus, a coated paper having an extensible cellulose layer ("extensible coated paper") exhibits mechanical properties comparable to plastic films, which are conventionally used as packaging material. Therefore, an extensible coated paper is even more suitable to be utilized on the same machine used for plastic packaging because of its increased elongation and elasticity.

In addition, it was found that compressing the cellulose layer in the machine direction, for example by creping, improves the coating adhesion and the heat-sealability of the coated paper.

High extensibility of the cellulose layer can be created by compressing the cellulose layer in machine direction (MD) and preferably by compacting the moist or dry paper web in machine direction (MD).

The compressing in the machine direction can be achieved by subjecting the cellulose layer to a step of creping or by using a Clupak unit. These processes are described in greater detail below.

An extensible coated paper within the meaning of the present invention is a coated paper having a tensile strength in machine direction and an elongation at break in machine direction as defined in the following. More particularly, an extensible coated paper within the meaning of the present invention has a tensile strength in machine direction of preferably 40-120 N/15 mm, and more preferably 60-100 N/15 mm, and an elongation at break in machine direction of preferably 3.5-25.0%, more preferably 4.5-15.0%, even more preferably 5.5-12.0%, and most preferably 6.0 to 8.0%. In a particularly preferred embodiment, the extensible coated paper has a tensile strength in machine direction of 60-100 N/15 mm and an elongation at break in machine direction of 6.0-8.0%.

The tensile strength of the coated paper in machine direction is preferably 40-120 N/15 mm, more preferably 60-100 N/15 mm. The tensile strength of the heat sealable paper in cross direction is 15-70 N/15 mm, more preferably 20-60 N/15 mm, and most preferably 30-50 N/15 mm.

The Cobb value of the coated paper as measured on a side comprising the coating is preferably 1-20 g/m$^2$, more preferably 1-12 g/m$^2$, and even more preferably 1-8 g/m$^2$.

The coated paper preferably has a tear resistance in the machine direction of 100-1000 mN, more preferably 300-800 mN and even more preferably 500-800 mN. The tear resistance in cross direction is preferably 100-1000 mN, more preferably 300-800 mN and even more preferably 500-800 mN.

The coated paper preferably has an elongation at break in machine direction 3.5-25.0%, more preferably 4.5-8.0% and even more preferably 6.0-7.0%.

When the cellulose layer used in the coated paper of the present invention is subjected to a step of compressing in machine direction, the coated paper is even more suitable to be utilized on the same machine used for plastic packaging because of its increased extensibility, elongation, elasticity and coating adhesion.

The compressing in machine direction can be achieved by subjecting the cellulose layer to a step of creping. Creping can be performed inside the paper machine (wet creping) or outside the paper machine (dry creping).

More particularly, during creping, the cellulose layer is moving on a crepe cylinder and is removed with a doctor blade, passed over the surface of the doctor blade to a transfer device, wherein the creping is controlled by retarding the speed of the transfer device, preferably by 10 to 50%, relative to the crepe cylinder. The degree of creping, i.e. the number of folds, can be controlled by adjusting the speed difference between the crepe cylinder and the transfer device.

In addition, the microstructure can be controlled by the geometry and the angle of the doctor blade. In this process, the dry content of the cellulose layer is preferably in the range of 30 to 50 wt.-%, preferably 35 to 45%.

Compressing of the cellulose layer in machine direction can also be achieved by using a Clupak unit.

A Clupak extensible unit comprises a cylinder, a nip bar, a gap between the cylinder and the nip bar, and a rubber band (rubber blanket) located in the gap. In a Clupak extensible unit, the rubber blanket has to pass through the gap between the drying cylinder and a nip bar.

The nip can be considered as a Venturi section formed by a rotating drying cylinder and the static nip bar, in which the endless rubber blanket is accelerated. The paper web follows the dimensional changes of the rubber surface in the nip due to friction forces between paper and rubber. This is a consequence of a high radial nip pressure and a simultaneous slippage of the paper on the cylinder surface. The dimensional changes of the rubber surface are induced by bending and by the Venturi effect. First, the surface of the rubber blanket closer to the paper web is stretched through bending over the nip bar and it is further stretched because of the Venturi effect. The stretched rubber surface then comes into contact with the moist paper web. After passing the center of the nip, the stretched rubber surface starts to recoil due to the deceleration caused by Venturi effect and bending of the rubber in the opposite direction. The paper web compacts in MD while following the shrinkage of the rubber surface in the second half of the nip and these events in the nip become more pronounced with increasing nip width. The final compression level is adjusted by controlling the speed difference of the paper web between inlet and outlet of the Clupak nip.

Compressing in machine direction by the use of a Clupak unit creates a microcreping effect in the paper network through curling of the fibers. The cellulose layer is compressed and the fibers are therefore pushed closer together, so that the cellulose layer is compressed in the machine direction. In this way, a series of small, generally discontinuous parallel folds are imparted to the cellulose layer. Microcreping differs from creping primarily in a larger number of the imparted folds and, thus, a larger number of overlaying folds. It was surprisingly found that microcreping does not only increase the elongation of the paper substrate but also further increases the adhesion of the subsequently applied coating compared to creping by the use of a creping cylinder. In addition, microcreping improves the heat-sealablity of the coated paper.

The cellulose layer used for the production of the coated paper of the present invention may be subjected to a step of calendering prior to coating.

The coated paper of the present invention may also be subjected to a step of calendering after the steps of coating and drying.

Calendering improves the smoothness and glossiness of the coated paper.

In the following, preferred embodiments of the invention will be described.

In one embodiment, the coated paper comprises:

- a cellulose layer having a first side and a second and opposite side;
- a barrier coating applied to at least the first side of the cellulose layer, wherein the barrier coating comprises a milk protein (in an amount of preferably 50 to 80 wt.-%, more preferably 55 to 75 wt.-%, even more preferably 60 to 70 wt.-%, in terms of the weight of the barrier coating); and
- a heat-sealable coating applied over the barrier coating, the heat-sealable coating comprising soy wax and a thermoplastic polysaccharide that is preferably derived from agricultural waste from corn. If a home-compostable paper is desired, the heat-sealable coating does not comprise a latex.

In another embodiment, the coated paper comprises:

- a cellulose layer having a first side and a second and opposite side;
- a barrier coating applied to at least the first side of the cellulose layer, wherein the barrier coating comprises a milk protein (in an amount of preferably 50 to 80 wt.-%, more preferably 55 to 75 wt.-%, even more preferably 60 to 70 wt.-%, in terms of the weight of the barrier coating) and a polyvinyl alcohol polymer (in an amount of preferably 20 to 50 wt.-%, more preferably 25 to 45 wt.-%, even more preferably 30 to 40 wt.-%, in terms of the weight of the barrier coating); and
- a heat-sealable coating applied over the barrier coating, the heat-sealable coating comprising soy wax and a thermoplastic polysaccharide that is preferably derived from agricultural waste from corn. If a home-compostable paper is desired, the heat-sealable coating does not comprise a latex.

In the above preferred embodiments, the basis weights are more preferably within the following ranges: 30 to 70 g/m$^2$ for the cellulose layer, 8 to 20 g/m$^2$ for the barrier coating and 4 to 15 g/m$^2$ for the heat-sealable coating.

In another aspect, the present disclosure is directed to a method of manufacturing a coated paper.

In one aspect, the method according to the present disclosure comprises the steps of providing a cellulose layer, applying an aqueous solution or an aqueous dispersion ("barrier coating composition") onto one side of the cellulose layer. The aqueous solution or aqueous dispersion contains a plant or animal derived component. The applied aqueous solution or aqueous dispersion is dried to form a barrier coating on the cellulose layer. An aqueous dispersion or emulsion ("heat-sealable coating composition") is then applied over the barrier coating. The aqueous dispersion or emulsion can contain a wax alone or in combination with a polymer. The aqueous dispersion or emulsion is applied in a manner that covers the barrier coating. The aqueous dispersion or emulsion is then dried to form a heat-sealable coating on top of the barrier coating.

In one aspect, the cellulose layer can initially be saturated with an aqueous composition containing the plant or animal derived component, which is preferably water-soluble or water-dispersible, and more preferably water-soluble, followed by being coated with an aqueous dispersion or emulsion that forms the heat-sealable coating.

In another aspect, the cellulose layer can initially be saturated with at least one compound selected from the group consisting of a wax, a polyester, a polysaccharide, polysaccharide ester, a polysaccharide ether, a polysaccharide ether ester, glycerol, polyethylene glycol, polyvinyl alcohol, softener and inorganic filler.

In the present specification, the term "saturation" is understood as synonymous with "impregnation". The amount of the different saturation ingredients in the heat-sealable paper is 2-20 g/m$^2$, preferably 3 to 15 g/m$^2$, and even more preferably 4-12 g/m$^2$. It is preferable to saturate the cellulose layer when the coating is applied on only one side of the cellulose layer.

As described above, the barrier coating and the heat-sealable coating can be applied to only one side of the cellulose layer. Alternatively, each side of the cellulose layer can include the barrier coating and the heat-sealable coating. If the barrier coating is formed on the cellulose layer, the heat sealable coating can be formed over the barrier coating using any suitable process or technique followed by curing and/or drying. The heat-sealable coating, for instance, can be formed by applying to the surface of the barrier coating a heat-sealable coating composition by spraying, brushing, or rolling. Upon application to the surface of the barrier coating, the heat-sealable coating composition undergoes film formation.

Preferably, liquid heat-sealable coating compositions of relatively low viscosity are applied to the barrier coating and are cured to form a solid, high-molecular-weight, polymer-based adherent film. The heat-sealable coating may also be formed by coalescence-based film formation. Coalescence-based film formation takes place with polymer particles dispersed in a liquid phase, preferably with latex polymers, and most preferably with water-dispersed polymers selected from the group consisting of polyester, polysaccharide, polysaccharide ester, polysaccharide ether and polysaccharide ether ester in combination with a wax.

The heat-sealable coating composition can be an aqueous dispersion or emulsion comprising a wax. The wax is preferably a wax as defined in the first aspect of the present invention. In other words, the wax is preferably a bio-based wax, more preferably a plant wax or an animal wax and is even more preferably a plant wax. The wax comprised in the heat-sealable coating compositions is even further more preferably one or more selected from the group consisting of candelilla wax, carnauba wax, rice bran wax, soy wax, sugar cane wax, sunflower wax, pea wax, coconut wax and palm tree wax and beeswax, and most preferably soy wax. The wax has preferably a dropping point in the range of 60° C. to 120° C.

The heat-sealable coating composition is preferably an aqueous emulsion comprising a wax and more preferably an aqueous emulsion comprising a wax and an emulsifier.

Emulsifiers are compounds that typically have a polar moiety and a non-polar moiety. Surfactants may be used as the emulsifier. The emulsifier is preferably an anionic or a non-ionic emulsifier and more preferably an anionic emulsifier The solid content of the heat-sealable coating composition, which is an aqueous dispersion or emulsion comprising a wax, is preferably 10 to 45 wt.-% based on the total weight of the heat-sealable coating composition. The viscosity of the barrier coating composition is preferably 200 to 1600 mPas, more preferably 500 to 1200 mPas.

After application of the barrier coating composition and heat-sealable coating composition, the coating compositions are dried to form a barrier coating and heat-sealable coating, respectively. In one aspect, the barrier coating composition can be applied and dried followed by application of the heat-sealable coating composition followed by drying. Drying may be carried out by blowing hot dry air onto the coating, thus raising the coating temperature to a point where water is evaporated from the coated paper, leaving a relatively dry coated paper. In the drying process, the web temperature, i.e. the temperature of the cellulose layer, must be lower than the dropping point of the wax. Thus, the web temperature during drying is preferably less than 120° C. The web temperature of the paper can be determined by means of non-contact temperature measurement using an infrared, non-contact thermometer.

The cellulose layer can be a wet-laid base sheet that may also be extensible. The cellulose layer is fed to a first coating applicator where an aqueous composition is applied to one side of the cellulose layer. The barrier coating can be applied by different coating technologies such as rod coater, curtain coater or air knife in order to form a coating on the cellulose layer having a desired thickness and/or basis weight. In this embodiment, the first coating or barrier coating is then dried.

The heat-sealable coating is applied by using any of the above mentioned coating technologies. The heat sealable coating is then dried in a second drying.

From the second drying, the coated paper can be fed to one nip calender and then to a cooling roller. At the end there is a winder.

Alternatively, a barrier coating can be formed on one side of the cellulose layer via extrusion. A barrier coating composition is thereby extruded on one side of the cellulose layer to form a barrier coating.

Test Methods:

The moisture vapor transmission rate (MVTR) can be determined according to DIN EN ISO 15106-3:2005-01 at a relative humidity of 50% and at a temperature of 23° C.

The "oxygen transmission rate" (OTR) can be determined according to DIN EN ISO Test 15105-2:2003 at a relative humidity of 50% and at a temperature of 23° C.

The tensile strength and the elongation at break can be determined according to ISO 1924:2016-08.

The tear resistance can be measured according to DIN EN ISO 1974:2012.

The basis weight of the cellulose layer and the coated paper can be determined according to ISO 536:2019-11. The basis weight of the barrier coating and the heat-sealable coating can be calculated therefrom.

The thickness can be determined according to EN ISO 534:2012-02 with a compressive load of 1.0 bar.

The Cobb value can be determined according to ISO 535:2014. The samples are measured after 10 minutes.

The present disclosure may be better understood with reference to the following example.

Example

A coated paper was made in accordance with the present disclosure and tested for various properties. The coated paper included a cellulose layer comprising a wetlaid web made from FSC certified virgin wood pulp fibers (e.g. softwood fibers) having a basis weight of about 60 g/m$^2$. The cellulose layer was coated on one side with a barrier coating composition comprising milk protein to form a barrier coating. The barrier coating composition was prepared by mixing milk protein provided as granules with cold water and stirring it for 2 hours to get a homogeneous, coatable solution. The barrier coating composition had a dry content of 15% from the milk protein. The barrier coating had a basis weight of about 10 g/m$^2$. The coated paper further included a heat-sealable coating applied over the barrier coating. The heat-sealable coating contained a soy wax in combination with thermoplastic polysaccharide derived from agricultural waste from corn and had a basis weight of about 10 g/m$^2$. The following results were obtained:

| Sample No. 1 | | Test method |
|---|---|---|
| Basis weight of cellulose layer [g/m$^2$] | 60 | ISO 536: 2019-11 |
| Thickness of the cellulose layer [mm] | 0.08 | EN ISO 534: 2012-02 |
| Tensile strength [N/15 mm] | 85.0 (MD) | ISO 1924: 2016-08 |
| Elongation [%] | 6 (MD) | ISO 1924: 2016-08 |

The following items are also part of the present disclosure:

[Item 1] A method of manufacturing a coated paper comprising:

providing a cellulose layer;

applying an aqueous solution or an aqueous dispersion of a plant or animal derived component onto one side of the cellulose layer;

drying the applied aqueous solution or aqueous dispersion to form a barrier coating on the cellulose layer, applying an aqueous dispersion or emulsion of a coating composition comprising a wax over the barrier coating; and drying the aqueous dispersion or emulsion to form a heat-sealable coating on top of the barrier coating.

[Item 2] The method as defined in item 1, wherein the cellulose layer is subjected to a step of compressing the cellulose layer in machine direction before coating to provide an extensible cellulose layer.

[Item 3] The method as defined in item 2, wherein the cellulose layer is compressed in machine direction by subjecting it to a step of creping.

[Item 4] The method as defined in item 3, wherein, in the step of creping the cellulose layer, the cellulose layer is moving on a crepe cylinder and is removed with a doctor blade, passed over the surface of the doctor blade to a transfer device, wherein the creping is controlled by retarding the speed of the transfer device by 10 to 50% relative to the crepe cylinder.

[Item 5] The method as defined in item 2, wherein the step of compressing the cellulose layer in machine direction occurs in a Clupak extensible unit comprising a cylinder, a nip bar, a gap between the cylinder and the nip bar, and a rubber band located in the gap.

[Item 6] The method as defined in any one of items 1 to 5, wherein, the barrier coating and the heat-sealable coating are formed on both sides of the cellulose layer.

[Item 7] The method as defined in any one of items 1 to 5, wherein the barrier coating and the heat-sealable coating are formed only on one side of the cellulose layer.

[Item 8] The method as defined in any one of items 1 to 7, wherein at least one side of the cellulose layer is subjected to a step of saturation prior to coating.

[Item 9] The method as defined in item 8, wherein the cellulose layer is saturated with at least one compound selected from the group consisting of a wax, a polyester, a polysaccharide, polysaccharide ester, a polysaccharide ether, a polysaccharide ether ester, glycerol, polyethylene glycol, polyvinyl alcohol, softener and inorganic filler.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed is:

1. A coated paper comprising:

a cellulose layer having a first side and a second and opposite side;

a barrier coating applied to at least the first side of the cellulose layer, wherein the barrier coating comprises an amorphous plant or animal derived component; and a heat-sealable coating applied over the barrier coating, the heat-sealable coating comprising a wax.

2. The coated paper as defined in claim 1, wherein the plant or animal derived component is water-soluble or water-dispersible.

3. The coated paper as defined in claim 1, wherein the plant or animal derived component is a milk protein.

4. The coated paper as defined in claim 1, wherein the barrier coating does not comprise a saccharide fatty acid ester.

5. The coated paper as defined in claim 1, wherein the barrier coating has a basis weight of at least about 10 $g/m^2$ and equal to or less than about 25 $g/m^2$.

6. The coated paper as defined in claim 1, wherein the barrier coating consists of the plant or animal derived component and polyvinyl alcohol polymer and a filler.

7. The coated paper according to claim 6, wherein the barrier coating consists of 10 wt.-% to 50 wt.-% of the plant or animal derived component with the remainder being polyvinyl alcohol polymer.

8. The coated paper as defined in claim 1, wherein the barrier coating further comprises a polyvinyl alcohol polymer and/or a nanocrystalline cellulose.

9. The coated paper as defined in claim 1, wherein the coated paper displays a moisture vapor transmission rate (MVTR) of less than about 10 $g/m^2/24$ hr and an oxygen transmission rate (OTR) of less than about 2 $cm^3/m^2/24$ hr.

10. The coated paper as defined in claim 1, wherein the coated paper has been calendered.

11. The coated paper as defined in claim 1, wherein the wax is a plant wax.

12. The coated paper as defined in claim 11, wherein the plant wax comprises candelilla wax, rice bran wax, soy wax, sugarcane wax, sunflower wax, pea wax, coconut wax, palm tree wax, or mixtures thereof.

13. A coated paper as defined in claim 1, wherein the heat-sealable coating further comprises a polymer comprising polyester, polysaccharide, polysaccharide ester, polysaccharide ether, polysaccharide ether ester, or latex polymer.

14. The coated paper as defined in claim 13, wherein the polymer is a thermoplastic starch.

15. The coated paper as defined in claim 1, wherein the coated paper passes compostable test EN 13432:2001.

16. The coated paper as defined in claim 1, wherein the coated paper does not contain a petroleum-based synthetic polymer.

17. The coated paper as defined in claim 1, wherein the coated paper does not contain any adhesive layers in between the barrier coating and the first side of the cellulose layer or between the barrier coating and the heat-sealable coating.

18. The coated paper as defined in claim 1, wherein the basis weight of the heat-sealable coating is from about 1 g/m2 to about 25 g/m2, wherein the cellulose layer has a basis weight of from about 20 g/m2 to about 100 g/m2, and wherein the coated paper has a basis weight of from about 25 g/m2 to about 125 g/m2.

19. The coated paper as defined in claim 1, wherein the cellulose layer comprises wood pulp fibers, bast fibers, or mixtures thereof.

20. A packaging comprising the coated paper as defined in claim 1.

* * * * *